US006675405B1

(12) United States Patent
Harm

(10) Patent No.: US 6,675,405 B1
(45) Date of Patent: Jan. 13, 2004

(54) TOILET PAPER MISTING DEVICE

(76) Inventor: Kip M. Harm, 627 Pines Way, Columbia, IL (US) 62236

( * ) Notice: Subject to any disclaimer, the term of this patent is extended or adjusted under 35 U.S.C. 154(b) by 0 days.

(21) Appl. No.: 10/201,726

(22) Filed: Jul. 23, 2002

(51) Int. Cl.[7] ..... E03D 9/00

(52) U.S. Cl. ..... 4/661; 4/420.4; 239/282; 239/289

(58) Field of Search ..... 4/300.1, 420.4, 4/447, 448, 661; 239/273, 282, 289

(56) References Cited

U.S. PATENT DOCUMENTS 2,852,782 A * 9/1958 Sundberg ..... 4/420.4
3,083,374 A 4/1963 Watlington
3,776,773 A 12/1973 Taft
4,135,255 A * 1/1979 Menendez ..... 4/448
4,197,594 A 4/1980 Butterfield
4,205,402 A 6/1980 Miller
4,451,943 A 6/1984 Nibler
4,510,630 A * 4/1985 Osgood ..... 4/420.4 X
5,044,556 A 9/1991 Suzuki
6,357,057 B1 * 3/2002 Krist ..... 4/420.4

* cited by examiner

*Primary Examiner*—Robert M. Fetsuga

(57) ABSTRACT

A personal hygiene device that releases an atomized mist of cool, soothing water onto toilet paper for use in washing and/or treating the rectal and genital areas. The device includes a water tube (14) that carries water to the housing (10) from a water source (38). The device is secured to the toilet using a mounting bracket (12), which utilizes the existing toilet seat securing hardware. A nozzle (24) releases the atomized mist of cool, soothing water onto toilet paper.

4 Claims, 5 Drawing Sheets

TOILET PAPER MISTING DEVICE

CROSS-REFERENCE TO RELATED APPLICATIONS

Not applicable.

FEDERALLY SPONSORED RESEARCH OR DEVELOPMENT

Not applicable.

BACKGROUND OF THE INVENTION—FIELD OF INVENTION

This invention relates to a water-dispensing device, which delivers an atomized mist of water directly on to toilet paper, relating generally to the field of personal hygiene.

BACKGROUND OF THE INVENTION

To cleanse the rectal and genital area immediately after moving the bowels or urinating, we utilize the personal hygiene product known as toilet paper. However, when using ordinary dry toilet paper, it is very uncomfortable and ineffective in cleaning fecal matter or urine completely from the region. Furthermore, for those who suffer with hemorrhoids or similar rectal tissue irritations, using dry toilet paper can be very painful.

Utilizing a "wet" cleansing method, versus dry toilet paper alone, is a much more sanitary, comfortable, and effective means of cleansing the rectal and genital area. Therefore, it should be easily understood that a "wet" cleansing method is an advantageous alternative to conventional "dry" methods for cleansing after moving the bowels or urinating, not only for those with medical problems, but also for the public at large.

The use of water for rectal and genital cleansing has been commonplace in Europe for years, primarily in the form of a bidet. In the United States, the use of wet wipes, or similar cleansing materials, has become common in recent years. The use of the traditional bidet has not been well accepted in this country, largely because a separate fixture is required, which is not readily accommodated in traditional bathroom structures, and it substantially increases the cost of a bathroom. In recent years, inventors have created several bidets that reside inside the toilet bowl—U.S. Pat. No. 4,197,594 (1980) & U.S. Pat. No. 4,205,402 (1980). These types of bidets eliminate the need for a separate fixture, but present a significant problem with maintaining sanitary conditions. Since the bidet resides inside the toilet bowl, whether or not it is retracted to a storage position therein, it is subject to contamination by the fecal matter or urine present in the toilet bowl. This contamination may cause infection and/or irritation to the user. For example, the patents referenced above provide bidets that are installed within the confines of the toilet bowl. Both of these inventions pose the risk of potential infection and/or irritation to the user.

Several patents have been issued for devices that dispense water directly on to toilet paper, or saturate toilet paper, to provide users with a more effective means of cleaning the rectal and genital area than traditional "dry" toilet paper methods. See U.S. Pat. No. 5,044,556 (1991), U.S. Pat. No. 3,776,773 (1973), U.S. Pat. No. 3,083,374 (1962), & U.S. Pat. No. 4,451,943 (1984).

U.S. Pat. No. 5,044,556 discloses a device for spraying water directly on to toilet paper; however, the device requires a significant amount of installation space due to its considerable size. Therefore, it is unable to be mounted in an easy, convenient, or attractive manner. Since the device does not have a water catching drip pan located underneath the vertical waterspout, it could drip after use and cause serious water damage to the user's floor. The device requires an electrical connection in order for it to function, and since an electrical outlet may not be conveniently located near the user's toilet, it could cause the user to either run an extension cord to the nearest electrical outlet, or install a new electrical outlet. Another disadvantage is that it does not allow for the release of non-heated water—many users prefer cool, soothing water, rather than heated water. Furthermore, no medication, fragrance, or additional liquid can be introduced, via the device.

U.S. Pat. No. 3,776,773 discloses a device for spraying water directly on to toilet paper. This device requires a significant amount of installation space due to its considerable size, and requires the user to permanently mount the unit onto a wall. A major disadvantage is that the user must manually fill the reservoir with liquid prior to use, and manually pump the device in order for liquid to be extracted from unit. This type of wetting device is difficult to operate and is less convenient, as it does not have an automatic continuous water supply. In addition, when the users pump the water out of the reservoir, they are only able to wet one sheet of toilet paper at a time, and the device only applies the water to a small portion of the toilet paper area. To achieve the desired result, a single toilet use could require the user to fill the reservoir repeatedly. Furthermore, the device has many exposed parts that could become contaminated by urine or fecal matter.

U.S. Pat. No. 3,083,374 discloses a device for applying water directly on to toilet paper. With this device, wetting of the toilet paper is achieved by dispensing water from a secondary reservoir, which is manually filled and is not connected to the toilet's water supply system. This type of wetting device is difficult to operate and is less convenient, as it does not have an automatic continuous water supply. The user must manually pump the device to initiate the flow of water into the reservoir and on to the toilet paper. In addition, this device requires a significant amount of installation space due to its considerable size, and requires mounting in an inconvenient, hard to reach location, on the toilet tank behind the user. Since the device requires the use of two (2) hands to function, the users must awkwardly twist their bodies' 180 degrees to reach and operate the device. Since the device does not have a water catching drip pan located underneath the vertical waterspout, it could drip after use and cause serious water damage to the user's floor. Furthermore, no medication, fragrance, or additional liquid can be introduced, via the device.

U.S. Pat. No. 4,451,943 discloses a device for applying water directly on to toilet paper, by manually dipping the toilet paper into a reservoir, which is connected to the toilet tank. The proposed wetting of toilet paper by dipping in water presents serious problems, as it tends to over-saturate and weaken the toilet paper, making effective cleansing difficult and messy. The device requires a significant amount of installation space due to its considerable size, and requires mounting in an inconvenient, hard to reach, location, on the toilet tank behind the user. The users must awkwardly twist their bodies' 180 degrees to reach and operate the device. And as with the previous device, it uses water from the toilet tank, versus obtaining the water directly from the source water line. In addition, since the water is supplied by the pressurized water system within the toilet tank, the toilet must be flushed in order for the flow of water to initiate. This causes to user to have to flush the toilet a minimum of two (2) times per use—once to wet the toilet paper for use, and again to dispose of the used toilet paper. Furthermore, no medication, fragrance, or additional liquid can be introduced, via the device.

BACKGROUND OF THE INVENTION

Accordingly, several objects and advantages of my invention are:

(a) to provide a toilet paper misting device which delivers an atomized mist of cleansing, soothing water on to toilet paper, which is held in ones hand;

(b) to provide a toilet paper misting device which provides a wet method of cleansing after moving the bowels or urinating, versus the typical "dry" wiping method;

(c) to provide a toilet paper misting device which results in a more sanitary, comfortable, and effective means of cleansing the rectal and genital area, than typical "dry" wiping method;

(d) to provide a toilet paper misting device which will provide relief for those who use the typical "dry" wiping method and suffer with hemorrhoids or similar irritations;

(e) to provide a toilet paper misting device which is an advantageous alternative to the typical dry wiping method of cleansing, not only for those with medical problems, but also for the public at large;

(f) to provide a toilet paper misting device which is able release the appropriate amount of liquid to the toilet paper, based upon the users desired level of wetness;

(g) to provide a toilet paper misting device which is easily mounted to the toilet, using the pre-existing bolts that secure the toilet seat;

(h) to provide a toilet paper misting device which is conveniently installed within the user's natural reach, right next to the toilet seat;

(i) to provide a toilet paper misting device which is attractively designed and compact in size;

(j) to provide a toilet paper misting device which does not require any electrical wiring or manual pumping to function;

(k) to provide a toilet paper misting device which is readily accommodated in traditional bathroom structures, and very inexpensive to produce;

(l) to provide a toilet paper misting device which resides outside the toilet bowl, thus significantly reducing the risk of contamination by the fecal matter and/or urine present in the toilet bowl;

(m) to provide a toilet paper misting device which is completely self-contained, thus significantly reducing the risk of contamination by the fecal matter and/or urine present in the toilet bowl;

(n) to provide a toilet paper misting device which has a drip pan located directly underneath the nozzle, catching any liquid droppings after spraying, and preventing serious water damage to the user's floor;

(o) to provide a toilet paper misting device which does not require the user manually to fill the device with liquid prior to use, or manually to pump the device in order for liquid to be extracted from unit;

(p) to provide a toilet paper misting device which has an automatic, continuous water supply, connected directly to the source water line, versus connecting to the toilet tank;

(q) to provide a toilet paper misting device which does not require the user to flush the toilet in order for the flow of water in the device to initiate;

(r) to provide a toilet paper misting device which releases the appropriate amount of liquid to the user's toilet paper, resulting in a more sanitary, comfortable, and effective means of cleansing the rectal and genital area;

(s) to provide a toilet paper misting device which does not over-saturate the toilet paper to the point of weakening the toilet papers strength;

(t) to provide a toilet paper misting device which can be operated using just one (1) hand to operate, versus having to use two (2) hands to operate, and can be installed on either side of the toilet;

(u) to provide a toilet paper misting device which does not require the user to awkwardly twist their body 180 degrees to reach and operate the device.

Further objects and advantages are to provide a device which is simple to use, inexpensive to manufacture, designed with very few internal or external parts, and installed in a short period of time, without having to make modifications to existing plumbing. Still further objects and advantage will become apparent from a consideration of the ensuing description and drawings.

BRIEF SUMMARY OF THE INVENTION

A device for dispensing water onto toilet paper, comprised of a housing that allows for passage of water being released onto the toilet paper; a tube for carrying the water from the source to said housing; means for joining said water tube to the water source; means for joining said water tube to said housing; a nozzle operatively connected to the water tube; a valve with a plunger, which opens and closes the water path between said water tube and said nozzle, a coil spring which biases the valve plunger toward closed condition, and a plunger operator, hingedly mounted on the housing and engaging the valve plunger in such a way that when the plunger operator is depressed, the plunger opens the valve and allows water to flow through the nozzle onto toilet paper.

BRIEF DESCRIPTION OF THE SEVERAL VIEWS OF THE DRAWINGS

The invention will be further understood if reference is made to the accompanying drawings in which.

DRAWINGS - REFERENCE NUMERALS

Figure 1:
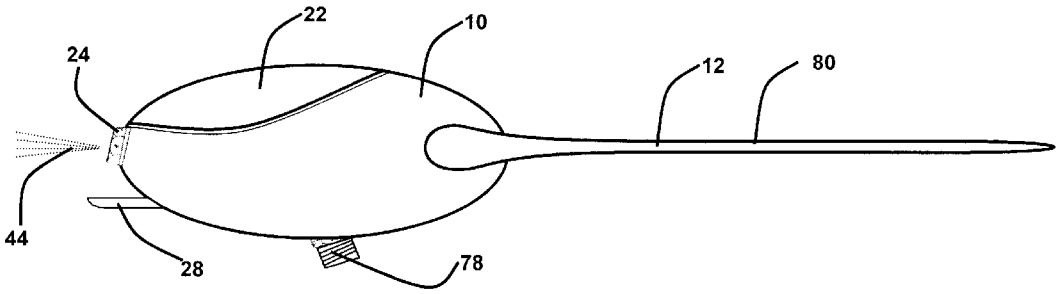
FIG. 1 shows a side view of a preferred embodiment of the invention.
Figure 2:
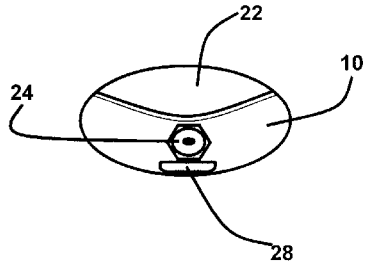
FIG. 2 shows a frontal view thereof.
Figure 3:
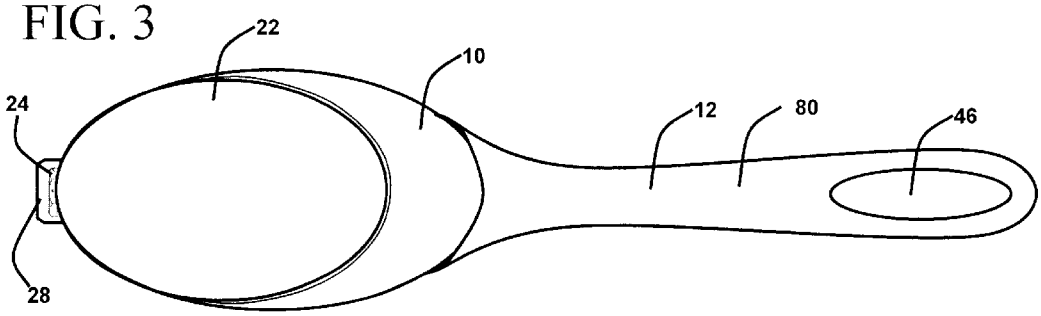
FIG. 3 shows a top view thereof.
Figure 4:
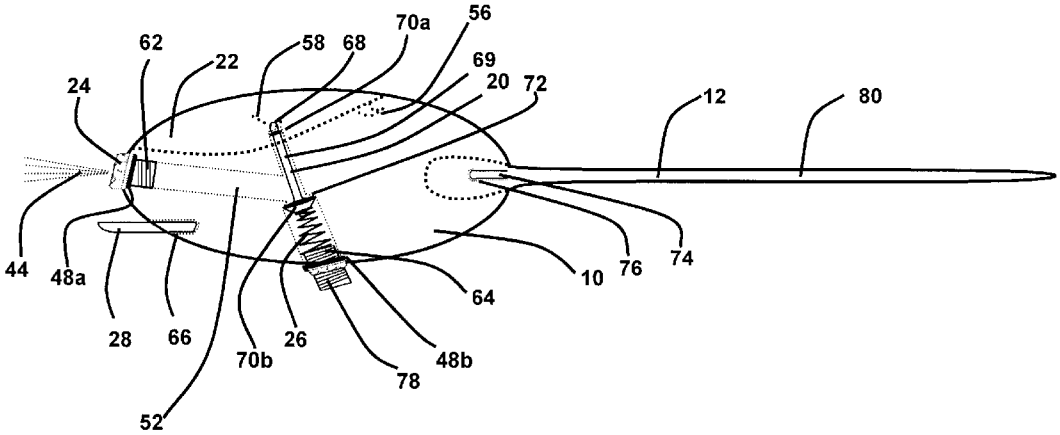
FIG. 4 shows a partial cutaway side view thereof.
Figure 5:
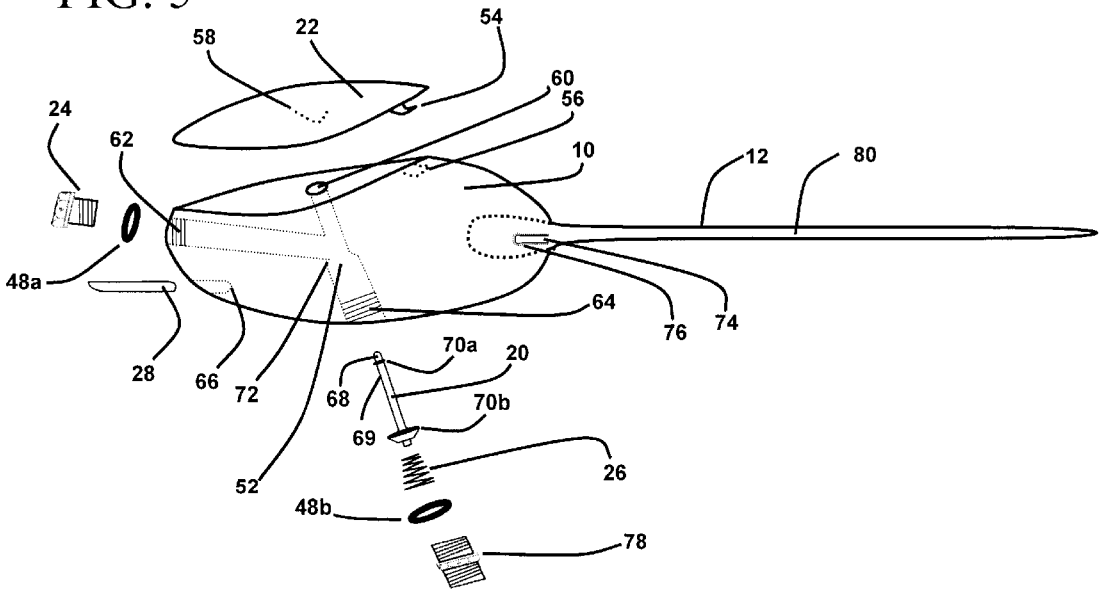
FIG. 5 shows an exploded cutaway side view thereof.

| | | | |
|---|---|---|---|
| 10 | Housing | 12 | Mounting bracket |
| 14 | Water tube | 16 | Self-tapping saddle valve |
| 18a | Threaded female tube connector | 18b | Threaded female tube connector |
| 20 | Valve | 22 | Plunger Operator |
| 24 | Threaded male nozzle | 26 | Coil |
| 28 | Drip channel | 30 | Toilet seat screw |
| 32 | Ordinary toilet | 34 | Toilet bowl |
| 36 | Toilet seat | 38 | Water source |
| 44 | Water mist end | 46 | Toilet seat screw hole |
| 48a | Threaded male nozzle gasket | 48b | Threaded male coupling gasket |
| 52 | Water passage conduit | 54 | Plunger operator anchor |
| 56 | Plunger operator anchor receiver | 58 | Valve plunger operator |
| 60 | Valve crown hole | 62 | Threaded female nozzle opening |
| 64 | Threaded female coupling opening | 66 | Drip channel cavity |
| 68 | Valve crown | 69 | Valve plunger |
| 70b | Large valve gasket | 70a | Small valve gasket |
| 72 | Valve seat | 74 | Mounting peg |
| 76 | Mounting peg cavity | 78 | Threaded male coupling |
| 80 | Support arm | | |

DETAILED DESCRIPTION OF INVENTION

A preferred embodiment of the present invention will now be described in detail, with reference to the accompanying drawings. First, the structure of the device will be explained in detail, with reference to FIGS. 1–5.

In the preferred embodiment, the housing (10) is an egg-shaped structure that has a water passage conduit (52) within, which allows for the flow of water through the housing. However, the housing can be physically constructed of various shapes, such as square, rectangular, circular, etc. Also, in the preferred embodiment, the housing is constructed of a non-porous, rigid plastic material. However, the housing can consist of and non-porous material, such as metal, porcelain, etc.

At a water mist (44) end of the housing (10) is a threaded female nozzle opening (62), which accommodates a threaded male nozzle (24) and male nozzle gasket (48*a*). The male nozzle gasket slides onto the threaded male nozzle, which is screwed into the threaded female nozzle opening thereby rigidly connecting the nozzle (24) to the housing (10).

Below the threaded male nozzle (24) at the water mist (44) end of the housing, is a drip channel (28) that extends outward from the housing (10), slightly further than the threaded male nozzle, to capture the excess water released from the threaded male nozzle. The drip channel is joined to the housing by inserting the drip channel into a drip channel cavity (66). The excess water evaporates while in the drip channel.

Located at the top of the housing (10), is a plunger operator (22), which is hingedly mounted on the housing by inserting a plunger operator anchor (54), made integral with the plunger operator, into an anchor receiver (56) molded into an underside of the housing. A valve plunger (69) is part of a valve (20). The valve plunger is connected to the plunger operator by a valve crown (68) at the outer end of the valve plunger, which extends upward through a valve crown hole (60) and into a slot located within the plunger operator.

The valve (20) is inserted through a threaded female coupling opening (64), up into the water passage conduit (52), so that the valve crown (68) protrudes through the valve crown hole (60) and rests in the valve plunger operator (58). A small valve gasket (70*a*) is attached to the base of the valve crown. When the valve crown is inserted through the valve crown hole, the small valve gasket (70*a*) provides for a watertight seal, keeping water in the water passage conduit from escaping through the valve crown hole. A large valve gasket (70*b*) is mounted on the valve plunger (69) near the inner end of the valve plunger. When the valve is fully inserted through the valve crown hole, the large valve gasket (70*b*) presses against an annular valve seat (72), providing a water-tight seal, keeping water from entering the water passage conduit.

A compression coil spring (26) is inserted into the water passage conduit (52) at the base of the housing (10), directly after the valve (20). A threaded male coupling gasket (48*b*) slides onto a threaded portion of a threaded male coupling (78), which is screwed into the threaded female coupling opening (64). The valve and coil spring are secured within the housing (10) as a result of screwing the threaded, male coupling securely into the threaded female coupling opening. When fully installed, the spring biases the plunger operator (22) upwardly around the hinge formed by the plunger operator anchor (54). This permits the large valve gasket (70*b*) to seat against the valve seat (72), and to permit the large valve gasket to be pushed from the valve seat when the plunger operator is manually depressed.

A mounting bracket (12), with a planar support arm (80) is joined to the rear of the housing (10) by insert a mounting peg (74) into amounting peg cavity (76). The mounting bracket support arm has a toilet seat screw hole (46) to accept a seat bolt to secure the device to a standard toilet outside the bowl (34).

Figure 6:
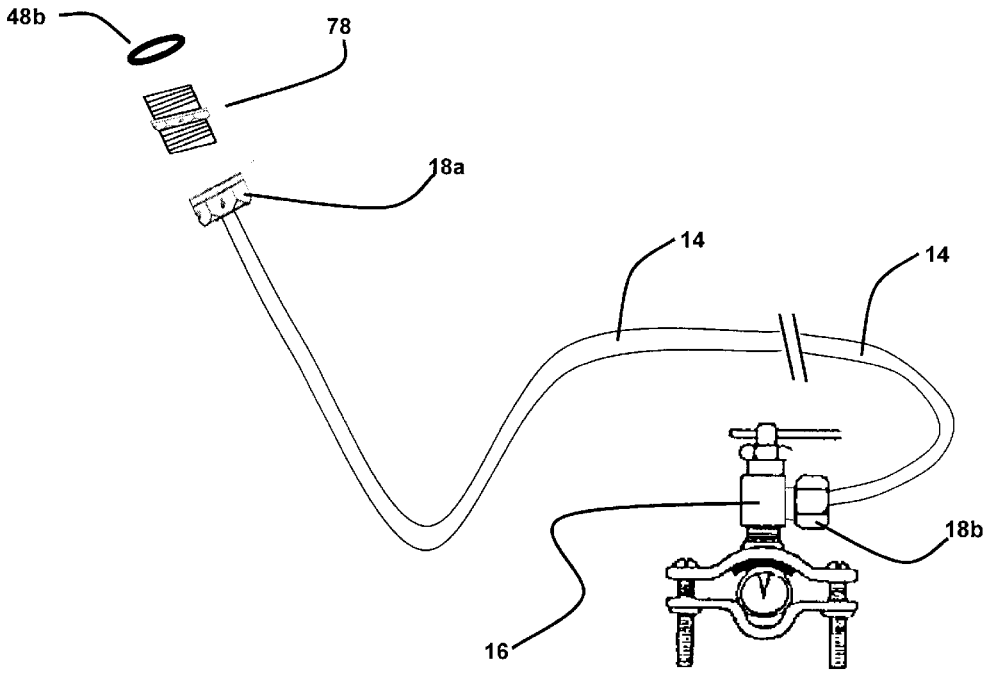
FIG. 6 shows a side view of the water source connector and water carrying tube.

FIG. 6 illustrates a water tube (14), which is constructed of a flexible plastic material. The water tube connects to the housing (10) by screwing the threaded female tube connector (18*a*) onto the threaded male coupling (78). However, the means of connecting the tube to the housing can be accomplished using various other types of fittings. A threaded female tube connector (18*b*) connects the tube to a self-tapping saddle valve (16). The self-tapping saddle valve connects directly to a water source (38). However, the means of connecting the tube to a water source and be accomplished using various other types of methods not shown.

Figure 7:
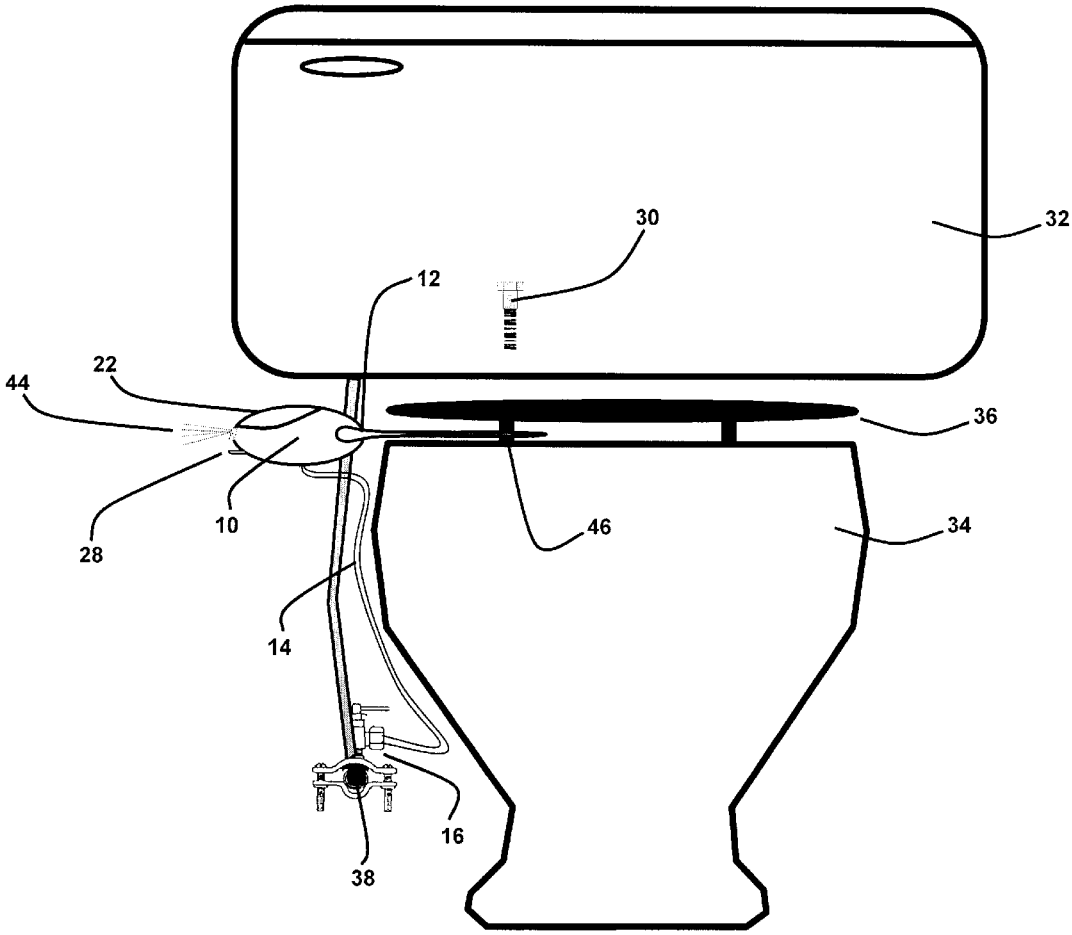
FIG. 7 shows a frontal view of an ordinary modern day toilet showing my invention in operative position thereon.
Figure 8:
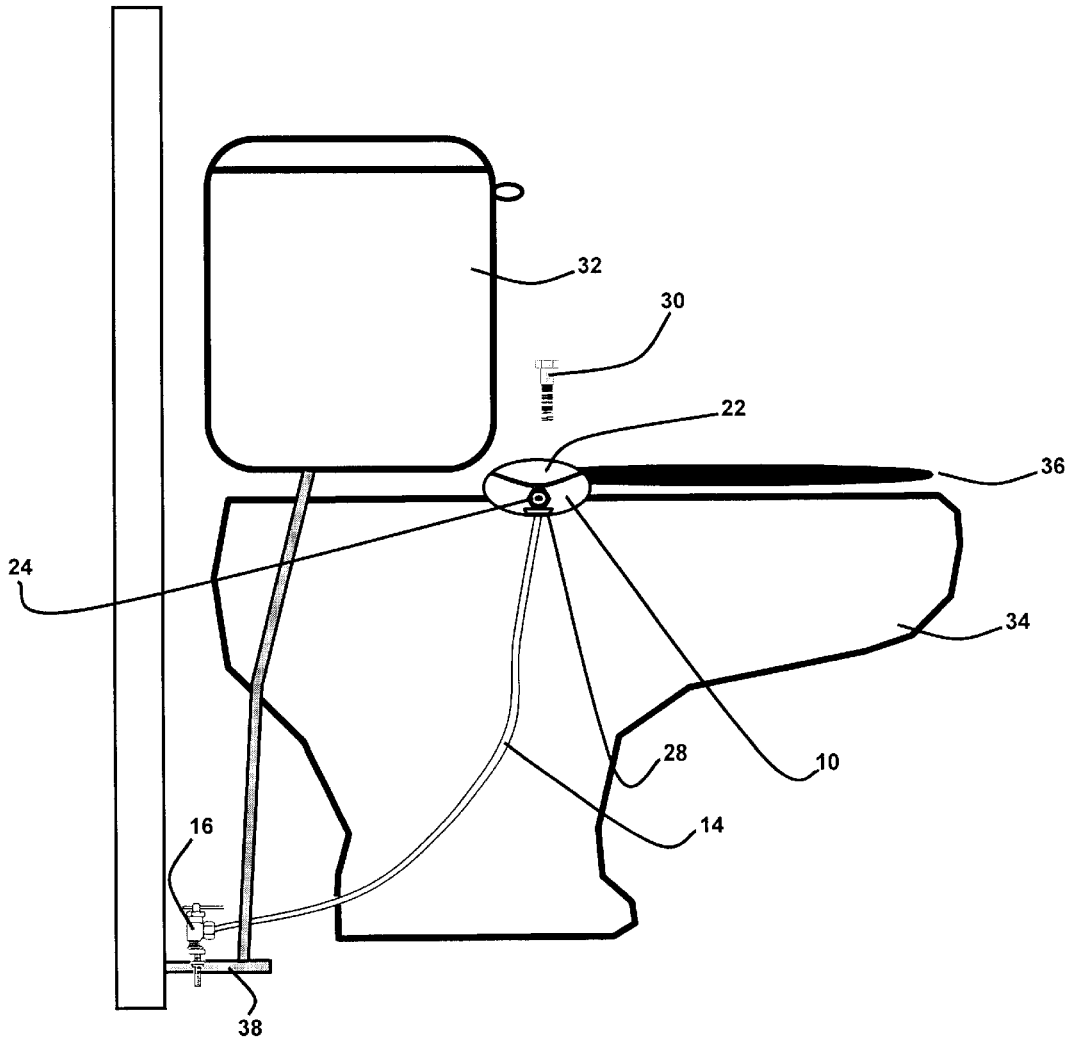
FIG. 8 shows a view in side elevation of the toilet of FIG. 7 my invention in operative position thereon.

FIGS. 7 and 8 are an isometric view of an ordinary toilet (32) of modern day commerce showing my invention in operative position thereon. The device attaches to the toilet by removing the toilet seat bolt (30) and placing the support arm (80) of the mounting bracket (12) between the toilet seat (36) and the toilet bowl (34), so that when the toilet seat bolt is re-inserted, it inserts through the toilet seat hinge fastener, then the support arm bolt hole (46), then the toilet bowl. The device can be mounted on either side of the toilet, to accommodate left or right-handed users. The self-tapping saddle valve (16) is connected to the water source (38) to initiate the flow of water to the housing (10).

OPERATION

To operate the device, toilet paper is held in the hand of a user and placed in front of the threaded male nozzle (24). While the toilet paper is in this position, the user pushes their palm downward on the plunger operator (22). As the plunger operator is depressed, the plunger pushes the large valve gasket (70*b*) downward away from the valve seat (72)

against the bias of the coil spring (26). This movement causes the valve to allow the release of water from the water source (38), up into the water tube (14), into the water passage conduit (52), laterally out through the threaded male nozzle (24), and onto the user's toilet paper.

When the appropriate amount of water is released on to the toilet paper, based upon the user's desired level of wetness, the user removes their palm from the plunger operator (22) causing the coil (26) to-expand, and the valve (20) to push upward until the large valve gasket (70*b*) comes into contact with the valve seat (72), providing for a water-tight seal, and stopping the flow of water.

It should be noted from the foregone description, that the device is relatively small compared to the size of an ordinary toilet. It should further be noted in connection with its use, that if desired, a water-warming device could be added or a warm water supply provided, to furnish warm water.

The foregone description of my invention is necessary, so that a specific embodiment of it might be set forth as required, but it is to be understood that various modifications of detail, rearrangement, and multiplication of parts might be resorted to without departing from its spirit, essence, or scope.

From the description above, a number of advantages of my toilet paper misting device become evident:

(a) The device delivers an atomized mist of cleansing, soothing water on to toilet paper, which is held in ones hand;

(b) The device provides a more effective wet method of cleansing after versus the typical "dry" moving the bowels or urinating, wiping method;

(c) The device provides a more sanitary, comfortable, and effective means of than typical "dry" wiping method cleansing the rectal and genital area;

(d) The device provides relief for those who use the typical "dry" wiping method and suffer with hemorrhoids or similar irritations;

(e) The device provides an advantageous alternative to the typical dry wiping method of cleansing, not only for those with medical problems, but also for the public at large;

(f) The device is able to release the appropriate amount of liquid on to toilet paper, based upon the users desired level of wetness;

(g) The device is easily mounted to the toilet, using the pre-existing bolt that secures the toilet seat;

(h) The device is conveniently installed within the users natural reach, right next to the toilet seat;

(i) The device is attractively designed and compact in size;

(j) The device does not require any electrical wiring or manual pumping to function;

(k) The device is readily accommodated in traditional bathroom structures, and very inexpensive to produce;

(l) The device resides outside the toilet bowl, thus significantly reducing the risk of contamination by the fecal matter and/or urine present in the toilet bowl;

(m) The device is completely self-contained, thus significantly reducing the risk of contamination by the fecal matter and/or urine present in the toilet bowl;

(n) The device has a liquid drip pan located directly underneath the nozzle, catching any liquid droppings after spraying, thus preventing serious water damage to the user's floor;

(o) The device does not require the user to manually fill the device with liquid prior to use, or manually pump the device in order for liquid to be extracted from unit;

(p) The device has an automatic, continuous water supply, connected directly to the source water line, versus connecting to the toilet tank;

(q) The device does not require the user to flush the toilet in order for the flow of water in the device to initiate;

(r) The device releases the appropriate amount of liquid to the user's toilet paper, resulting in a more sanitary, comfortable, and effective means of cleansing the rectal and genital area;

(s) The device does not over-saturate the toilet paper to the point of weakening the toilet papers strength;

(t) The device can be operated using just one (1) hand to operate, versus having to use two (2) hands to operate, and can be installed on either side of the toilet;

(u) The device does not require the user to awkwardly twist their body 180 degrees to reach and operate the device;

(v) The device has very few internal or external parts, and can be installed in a short period of time, without having to make modifications to existing plumbing.

CONCLUSIONS, RAMIFICATIONS, AND SCOPE

Accordingly, the reader will see that the toilet paper misting device provides for a more effective, wet method of cleansing after moving the bowels or urinating, versus the typical "dry" wiping method. The result is a more sanitary, comfortable, and effective means of cleansing the rectal and genital area.

While my above description contains many specifics, these should not be construed as limitations on the scope of the invention, but rather as an exemplification of on preferred embodiment thereof. Many other variations are possible. For example, the housing can be produced in many other various shapes, such as circular, trapezoidal, triangular, square, etc. The means of connecting the water tube to the water source and housing can accomplished using various methods, such as bolts, clamps, couplings, etc. The mounting plate can be connected to the toilet using various methods, such as a clamp, adhesive, "u"-shaped bracket, etc. The coil spring, which applies compression to the valve plunger, can be substituted with any object that provides similar bias. The device can be produced with a means of introducing a secondary liquid to the toilet paper, such as medication, fragrance, or other liquid. The plunger operator can be hinged differently, with a living hinge, or a piano hinge, either of separate components or with integral knuckles and a separate pintle, for example.

Accordingly, the scope of the invention should be determined not by the embodiment illustrated, but by the appending claims and their legal equivalents.

I claim:

1. A device for dispensing water in the form of a mist onto toilet paper, comprising:

(a) a housing, that allows for passage of water to be misted onto the toilet paper, (b) a toilet having a bowl and means of securing said housing to the toilet, (c) a tube for carrying the water from a source to said housing, (d) means for joining said tube to said source, (e) means for joining said tube to said housing, (f) a nozzle, which discharges as a mist, water that flows through said housing, said nozzle being rigidly mounted outside the bowl of said toilet and oriented to direct the mist of water in a direction laterally away from the bowl, and (g) a valve, which opens and closes the water path between said tube and said nozzle.

2. The device for dispensing water in the form of a mist onto toilet paper of claim 1 wherein:

(a) said valve has a plunger movable between valve open and valve closed positions, (b) means for biasing said valve plunger toward valve closed position, and (c) a plunger operator, which when moved against the bias of said biasing means, moves said plunger to open said valve to initiate the flow of water through said housing, hence through said nozzle, in a direction laterally away from the bowl, onto toilet paper.

3. The device for dispensing water in the form of a mist onto toilet paper of claim 1, wherein said device housing has a drip channel for receiving liquid drippings after dispensing.

4. The device for dispensing water onto toilet paper, comprising;

(a) a housing, that allows for passage of water to be released onto the toilet paper, (b) a means of securing said housing to a toilet, (c) a tube for carrying the water from a source to said housing, (d) means for joining said tube to said source, (e) means for joining said tube to said housing, (f) a nozzle, which discharges water that flows through said housing, (g) a valve, which opens and closes the water path between said tube and said nozzle, said valve has a plunger movable between valve open and valve closed positions, (h) means for biasing said valve plunger toward valve closed position, and (i) a plunger operator, which when moved against the bias of said biasing means, moves said plunger to open said valve to initiate the flow of water through said housing, hence through said nozzle, onto toilet paper, wherein said device housing has a drip channel for receiving liquid drippings after dispensing.

* * * * *

UNITED STATES PATENT AND TRADEMARK OFFICE

CERTIFICATE OF CORRECTION

PATENT NO. : 6,675,405 B1
DATED : January 13, 2004
INVENTOR(S) : Kip M. Harm

It is certified that error appears in the above-identified patent and that said Letters Patent is hereby corrected as shown below:

Column 9,
Line 25, claim 4 should start with the word -- A -- instead of "The".

Signed and Sealed this

First Day of June, 2004

JON W. DUDAS
*Acting Director of the United States Patent and Trademark Office*